US010317028B2

(12) United States Patent
Bochenek

(10) Patent No.: US 10,317,028 B2
(45) Date of Patent: Jun. 11, 2019

(54) LIGHTING DEVICE MADE UP OF LIGHTING ELEMENTS AND STRIPLIGHT MADE UP OF A PLURALITY OF SUCH LIGHTING DEVICES

(71) Applicant: Stephane Bochenek, Yerres (FR)

(72) Inventor: Stephane Bochenek, Yerres (FR)

( * ) Notice: Subject to any disclaimer, the term of this patent is extended or adjusted under 35 U.S.C. 154(b) by 58 days.

(21) Appl. No.: 15/189,865

(22) Filed: Jun. 22, 2016

(65) Prior Publication Data

US 2017/0328530 A1 Nov. 16, 2017

(30) Foreign Application Priority Data

May 13, 2016 (EP) ..... 16169730

(51) Int. Cl.

| | |
|---|---|
| ***F21S 9/02*** | (2006.01) |
| ***F21S 6/00*** | (2006.01) |
| ***F21S 9/00*** | (2006.01) |
| ***F21S 8/00*** | (2006.01) |
| ***F21V 3/06*** | (2018.01) |
| ***F21V 3/02*** | (2006.01) |
| ***F21V 15/01*** | (2006.01) |
| ***F21V 23/02*** | (2006.01) |
| ***G08B 13/196*** | (2006.01) |

(Continued)

(52) U.S. Cl.

CPC ..... *F21S 9/02* (2013.01); *F21K 9/20* (2016.08); *F21S 2/005* (2013.01); *F21S 6/00* (2013.01); *F21S 8/00* (2013.01); *F21S 8/085* (2013.01); *F21S 9/00* (2013.01); *F21V 3/02* (2013.01); *F21V 3/06* (2018.02); *F21V 15/01* (2013.01); *F21V 23/009* (2013.01); *F21V 23/02* (2013.01); *G08B 13/19632* (2013.01); *F21S 8/043* (2013.01); *F21V 33/0052* (2013.01); *F21W 2131/103* (2013.01); *F21Y 2101/00* (2013.01); *F21Y 2107/40* (2016.08); *F21Y 2115/10* (2016.08)

(58) Field of Classification Search

CPC ..... F21S 6/00; F21S 6/002; F21S 9/02; F21S 9/00; F21S 8/00; F21S 8/026; F21S 8/028; F21S 8/04; F21S 8/085

See application file for complete search history.

(56) References Cited

U.S. PATENT DOCUMENTS 5,523,929 A * 6/1996 Ogihara ..... F21S 9/037 362/183
6,439,740 B1 * 8/2002 Yan ..... F21S 6/00 362/147

(Continued)

FOREIGN PATENT DOCUMENTS

JP 2004013617 A * 1/2004
JP 2015186218 A * 10/2015

*Primary Examiner* — Daniel I Walsh
(74) *Attorney, Agent, or Firm* — Amster, Rothstein & Ebenstein LLP

(57) ABSTRACT

Said lighting device is made up of lighting elements (L1, L2, . . . , L20) arranged on a mounting board (PS1, PS2, etc.). The one or more boards are arranged so as to supply light with a predetermined coverage.
The boards comprise a plugging system (C1, C2, C3, P1, P2, P3) for connecting said lighting elements. The mounting of such a device using a threaded rod 7 makes it possible to obtain easy maintenance of the device of the invention. This device can easily be used to form striplights.
Use: Lighting of car parks, meeting rooms.

13 Claims, 4 Drawing Sheets

Figure 1:
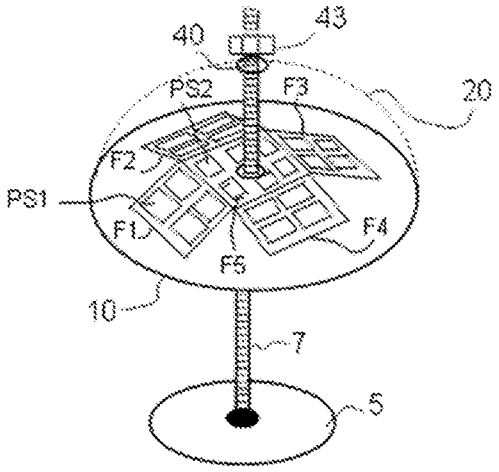

(51) Int. Cl.

| | |
|---|---|
| ***F21S 2/00*** | (2016.01) |
| ***F21S 8/08*** | (2006.01) |
| ***F21V 23/00*** | (2015.01) |
| ***F21K 9/20*** | (2016.01) |
| *F21V 33/00* | (2006.01) |
| *F21S 8/04* | (2006.01) |
| *F21W 131/103* | (2006.01) |
| *F21Y 101/00* | (2016.01) |
| *F21Y 115/10* | (2016.01) |
| *F21Y 107/40* | (2016.01) |

(56) References Cited

U.S. PATENT DOCUMENTS 9,414,454 B2* 8/2016 Brandes
9,638,403 B1* 5/2017 Marshal ..... F21V 21/108
10,077,892 B2* 9/2018 Li ..... F21S 2/00
10,100,987 B1* 10/2018 Dell'Ario ..... F21S 6/008
2002/0136010 A1* 9/2002 Luk ..... F21V 14/02 362/249.02
2002/0145878 A1* 10/2002 Venegas, Jr. ..... F21S 8/083 362/431
2003/0112627 A1* 6/2003 Deese ..... F21V 21/0832 362/249.01
2003/0235055 A1* 12/2003 Lodhie ..... B64D 47/02 362/470
2004/0160199 A1* 8/2004 Morgan ..... A01M 1/04 315/312
2005/0024870 A1* 2/2005 Coushaine ..... F21K 9/00 362/249.02
2005/0068765 A1* 3/2005 Ertze Encinas ..... F21S 9/037 362/183
2005/0086801 A1* 4/2005 Liu ..... F21K 9/00 29/854
2005/0195597 A1* 9/2005 Wesson ..... H01L 25/0753 362/231
2005/0219860 A1* 10/2005 Schexnaider ..... F21S 8/04 362/601
2006/0056179 A1* 3/2006 Fan ..... F21V 5/00 362/249.04
2006/0109667 A1* 5/2006 Flaherty ..... F21S 8/083 362/431
2008/0002399 A1* 1/2008 Villard ..... F21S 8/086 362/184
2008/0062689 A1* 3/2008 Villard ..... F21V 14/02 362/249.07
2008/0062691 A1* 3/2008 Villard ..... F21V 14/02 362/249.16
2008/0080187 A1* 4/2008 Purinton ..... F21K 9/00 362/294
2008/0212324 A1* 9/2008 Lin ..... F21S 6/003 362/287
2008/0212329 A1* 9/2008 Duguay ..... F21S 8/086 362/310
2008/0272705 A1* 11/2008 Yang ..... H05B 33/0803 315/194
2008/0291673 A1* 11/2008 Chen ..... F21S 6/003 362/231
2009/0080187 A1* 3/2009 Chou ..... F21V 29/006 362/231
2009/0267540 A1* 10/2009 Chemel ..... F21S 9/043 315/297
2009/0303703 A1* 12/2009 Kao ..... F21S 8/086 362/183
2010/0124059 A1* 5/2010 Duffy ..... F21K 9/23 362/249.03
2010/0141153 A1* 6/2010 Recker ..... H05B 33/0803 315/149
2010/0142205 A1* 6/2010 Bishop ..... F21V 21/00 362/249.02
2010/0238671 A1* 9/2010 Catone ..... F21S 8/086 362/373
2010/0296285 A1* 11/2010 Chemel ..... F21S 2/005 362/235
2010/0296298 A1* 11/2010 Martin, Jr. ..... A45D 42/10 362/311.06
2010/0302758 A1* 12/2010 Wang ..... F21S 9/022 362/20
2010/0302779 A1* 12/2010 Chemel ..... H05B 37/029 362/249.02
2010/0321930 A1* 12/2010 Watanabe ..... F21S 8/086 362/184
2011/0006657 A1* 1/2011 Liu ..... F21V 29/004 313/12
2011/0013397 A1* 1/2011 Catone ..... F21S 8/086 362/244
2011/0060701 A1* 3/2011 Verfuerth ..... F21S 8/086 705/500
2011/0063843 A1* 3/2011 Cook ..... F21V 29/004 362/249.02
2011/0156583 A1* 6/2011 Chuang ..... F21V 3/00 315/32
2011/0158637 A1* 6/2011 Jung ..... G03B 15/03 396/535
2011/0175533 A1* 7/2011 Holman ..... E04B 9/32 315/130
2011/0227510 A1* 9/2011 Elberbaum ..... G08C 23/06 315/363
2012/0038490 A1* 2/2012 Verfuerth ..... H05B 37/0272 340/910
2012/0087125 A1* 4/2012 Liu ..... F21S 2/005 362/241
2012/0113646 A1* 5/2012 Carmody ..... F21V 33/0076 362/253
2012/0182768 A1* 7/2012 Maslowski ..... F21K 9/232 362/646
2012/0194069 A1* 8/2012 Wang ..... F21S 8/04 315/32
2012/0194071 A1* 8/2012 Huang ..... F21K 9/13 315/35
2012/0218764 A1* 8/2012 Williamson ..... F21V 29/20 362/294
2012/0250323 A1* 10/2012 Velu ..... F21V 29/004 362/249.02
2012/0287636 A1* 11/2012 Chen ..... F21K 9/232 362/249.02
2013/0044488 A1* 2/2013 Hreish ..... F21V 33/00 362/253
2014/0133400 A1* 5/2014 Ruan ..... H04W 4/18 370/328
2014/0232288 A1* 8/2014 Brandes ..... H05B 33/0803 315/250
2015/0211719 A1* 7/2015 Moon ..... F21V 23/006 362/646
2015/0256665 A1* 9/2015 Pera ..... H04L 12/2803 455/420
2016/0003463 A1* 1/2016 Rodinger ..... F21K 9/23 362/249.02
2016/0025272 A1* 1/2016 Kim ..... F21V 5/04 362/235
2016/0091147 A1* 3/2016 Jiang ..... H05B 33/0845 315/205
2016/0097522 A1* 4/2016 Chien ..... F21V 33/00 362/183
2017/0019963 A1* 1/2017 Scarlata ..... H05B 33/0815
2017/0328530 A1* 11/2017 Bochenek ..... F21V 3/06

* cited by examiner

LIGHTING DEVICE MADE UP OF LIGHTING ELEMENTS AND STRIPLIGHT MADE UP OF A PLURALITY OF SUCH LIGHTING DEVICES

The present invention relates to a lighting device made up of lighting elements and a supply circuit for powering said elements.

The present invention also relates to a striplight made up of a plurality of such lighting devices.

Such devices are generally known, especially those that use LEDs as lighting elements. LEDs provide powerful light considering the electric power they consume. Many applications require intense omnidirectional lighting, while LEDs instead provide highly directional light outputs.

The aim of the invention is to provide a lamp that benefits from the efficiency of LEDs and which lights in an omnidirectional manner, while making it possible to obtain high light intensity.

For this purpose, a device of the type mentioned in the preamble is characterised in that said elements are organised in at least one assembly of at least one lighting element.

According to one aspect of the invention, the device comprises a plurality of said assemblies arranged on at least one mounting board and arranged so as to provide lighting according to a predetermined coverage.

Thus, by increasing the number of assemblies guided in different directions, omnidirectional lighting or lighting having a given light coverage is obtained, as well as luminosity which can be stronger.

One interesting application of the invention is that which relates to lighting in car parks, which requires easy maintenance and installation.

For maintenance, the invention proposes a system for plugging in boards in order to facilitate the replacement thereof in the event of a fault. As regards ease of installation, the supply circuit is of a type controlled to adjust the supply voltage of the lighting elements by also compensating for possible voltage drops due to the length of the power cable intended for powering the striplight. Indeed, when dealing with a striplight comprising such devices, the accessible voltage at the end of the striplight is considerably lower than at the start. It should be noted that the power cable, preferably carrying a low voltage, does not require any precautions or authorisation for the installation of such a striplight.

Figure 2:
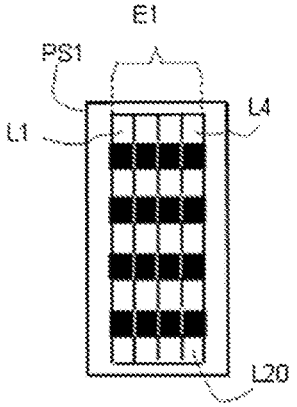
Figure 3:
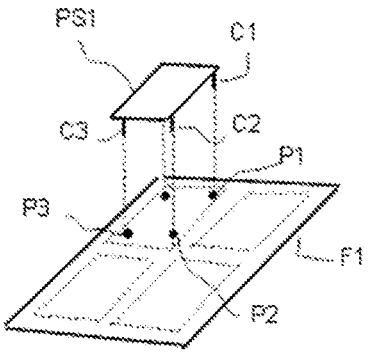
Figure 4:
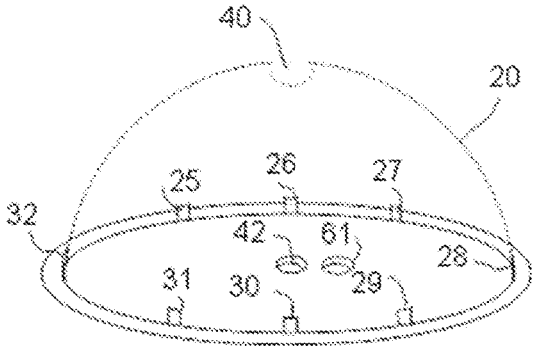
Figure 5:
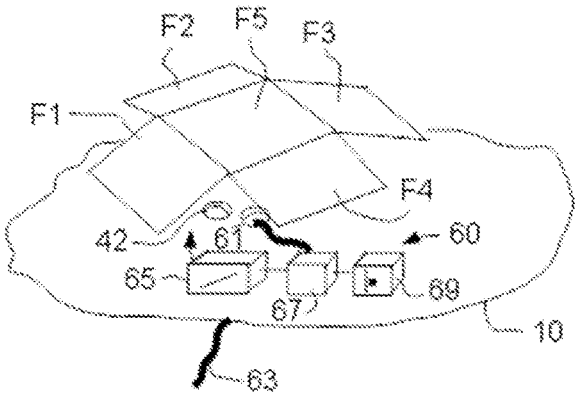
Figure 6:
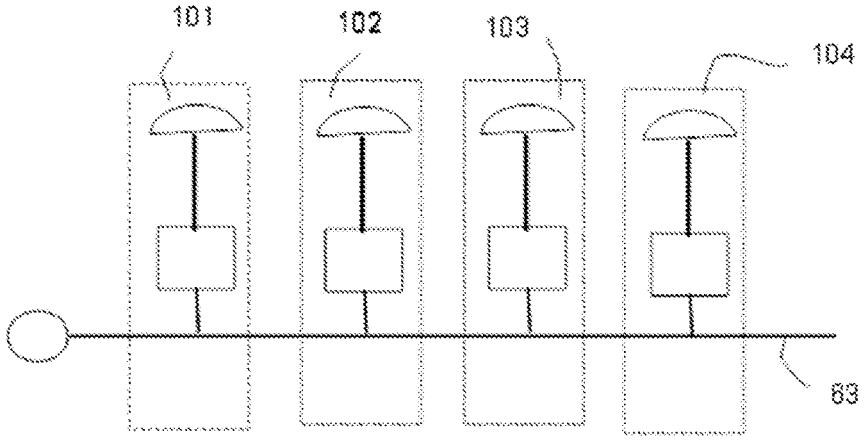
Figure 7:
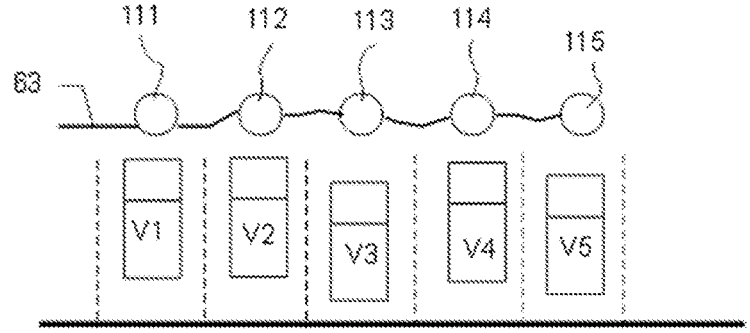
Figure 7:
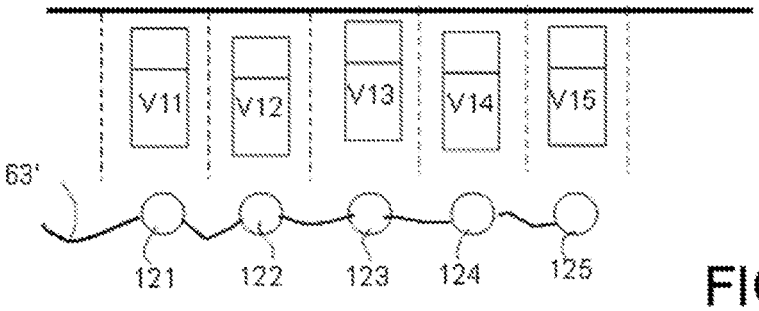
Figure 8:
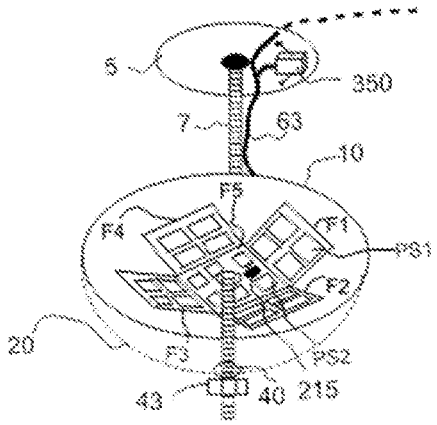
Figure 9:
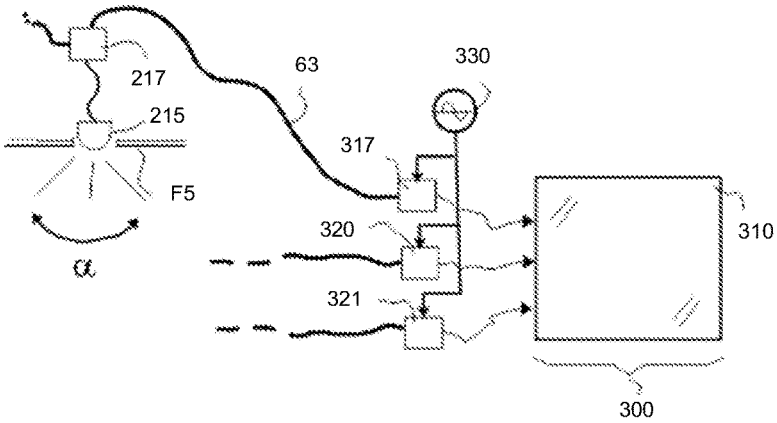
Figure 10:
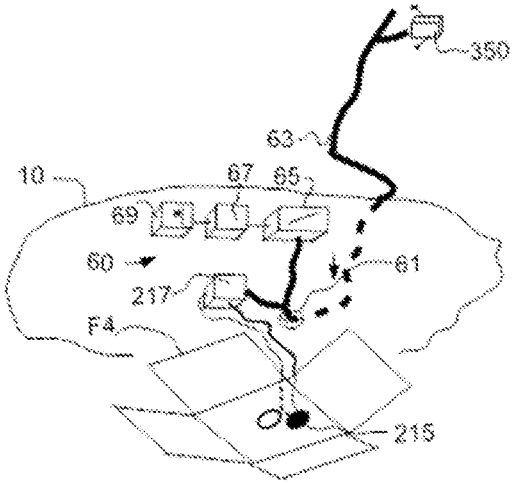

The following description, supported by the appended drawings, all provided as a non-limiting example, will easily explain how the invention can be carried out. In the drawings:

FIG. 1 shows in perspective a lighting device in accordance with the invention, FIG. 2 shows a board for assemblies of lighting elements that is suitable for a device according to the invention, FIG. 3 shows how said boards of assemblies are plugged into light facets placed on the supporting plate of the device, FIG. 4 shows how the protective dome of the device is arranged on the supporting plate, FIG. 5 shows an arrangement of the supply elements of said device of the invention, FIG. 6 shows a strip of lighting devices in accordance with the invention, FIG. 7 shows strips in accordance with the invention for lighting a car park, FIG. 8 shows an example of an embodiment of a lighting device in accordance with the invention, FIG. 9 shows the transmission of images involving the device shown in FIG. 8, FIG. 10 explains the connections of the device shown in FIG. 8.

In these figures, the common elements all have the same references in all the figures.

In FIG. 1, the lighting device shown is made up of a circular base 5, for example. The end of a threaded rod 7 is secured to the centre of this base. A supporting plate 10 with said threaded rod 7 passing through same is secured at a certain distance from the base 5. This distance is determined by a nut, not shown, which blocks the vertical movement of this supporting plate 10. Light facets F1, F2, F3, F4 and F5 are arranged on said supporting plate. Mounting boards are secured to said facets, some of which (PS1, PS2, etc.) are only referenced in the figure in order to avoid crowding it. An assembly E1 of lighting elements L1 to L20 is placed on each of these boards, as shown in FIG. 2. The positioning of the facets and even of said boards makes it possible to adjust the direction and spatial distribution of the light beams.

FIG. 3 shows that the mounting boards PS1 are removable with a view to facilitate the replacement thereof. For this purpose, connectors C1, C2, C3, etc. secured to the boards PS1 are provided on said boards and engage with sockets P1, P2, P3 respectively arranged on the light facets (F1, etc.).

The lighting device comprises a protective dome made of transparent material such as polymethyl methacrylate, better known by its commercial name of "Plexiglas". This dome 20 is provided with a semi-spherical shape, and its base rests on the supporting plate 10. Lugs 25, 26, 27, . . . , 31 are provided in order to centre said dome, as shown in FIG. 4. These lugs are arranged at the periphery of the supporting plate 10. A hole 40 at the top of this dome allows the threaded rod 7 to be pass through same. Another hole 61, visible in FIG. 4, is made in the supporting plate 10 for passing a cable 63. A nut 43 holds said dome 20 against the supporting plate 10.

A supply circuit 60 is placed under the light facets F1 to F5. Said circuit is connected to the power cable 63 which passes through the hole 61. Said circuit is made up of a transformer 65, control electronics 67 and an accumulator system 69. The transformer is of a controlled type which provides, in particular for lighting, a predetermined voltage for a voltage range which is applied at the input thereof. The accumulator 69 preserves the lighting during a power cut and can also supply a backup voltage to at least one lighting element.

The mounting of the device of the invention by means of a threaded rod allows for easy removal which, associated with the possibility of easily changing the mounting boards (PS1 etc.) allows for very easy maintenance of said device.

Advantageously, the devices of the invention are well suited to a strip configuration. The invention makes it possible to play with the distribution of light by tilting the various facets (F1, F2, etc.) in order to obtain the required distribution or coverage of each device. Moreover, the voltage control provided by the controlled transformers makes it possible to obtain long-span striplights without any deterioration of the light intensity at the end of the line. FIG. 6 shows the structure of such a striplight, which is made up of a plurality of devices in accordance with the invention 100, 101, 102, 103, which are all connected to a power cable 63.

One field of application of such a striplight is the lighting of a car park. This is shown in FIG. 7. The car park is made up of two rows: a first row for vehicles V1, V2, . . . , V5 and a second row for vehicles V11, V12, . . . , V15. A striplight is assigned to each of these rows. A first striplight is assigned to the first row and is made up of lighting devices 111, 112, 113, 114 and 115. These devices are powered by the cable 63. A second row is illuminated by the lighting devices 121, 122, 123, 124 and 125. They are powered via a power cable 63'. It should be noted that since such striplights can have a low voltage value, these lamps do pose any danger during crashes with manoeuvring vehicles.

Another example of a use of the invention is shown in FIG. 8. In this example, the lamp is attached to the ceiling of a room and a video camera 210 has been inserted for surveillance of this room. The lens of this camera is flush with the outside of the facet F5, as shown in FIG. 9. Its arrangement is such that it makes it possible to view objects according to an angle α which is as large as possible, and it is recessed enough to avoid the glare from the surrounding LEDs.

This camera 215 is connected to a PLC device 217 (device for coupling by powerline communication) which makes it possible to transmit a supply current and data over a single line, and thus to transmit the images captured by the camera 215 to a surveillance centre 300 in order to be viewed on a screen 310. The images can be accessed in the surveillance centre 300 by another PLC device 317, by travelling through the cable 63. Reference 330 indicates a power source for at least one lamp. The surveillance centre 300 can be provided with various PLC devices 320, 321, etc., assigned to various cameras which are part of various lamps.

FIG. 10 shows that, just like in FIG. 5, the various elements, including the coupling device 217, are placed under the light facets F1, . . . , F5.

The lighting device can also be used in the context of lighting a room such as an office or a meeting room. It is possible to attach a strong Wi-Fi booster of the type used in this type of room to the base 5 of the lamp. This is indicated by reference 350. This allows the participants meeting in the work room to connect easily to the Wi-Fi network.

The invention claimed is:

1. Lighting device comprising:

lighting elements arranged in one or more assemblies;

a supply circuit for powering the lighting elements;

a plurality of light facets comprising a central light facet and a plurality of peripheral light facets arranged around all sides of the central light facet;

one or more mounting boards arranged on each of the plurality of light facets, each of the one or more assemblies being positioned on a corresponding one of the one or more mounting boards, wherein distribution of light emitted by the lighting elements is adjusted by tilting each of the plurality of light facets in an adjustable manner; and a plug-in system that provides electrical connection between the lighting elements and the supply circuit, the plug-in system comprising for each of the one or more mounting boards a plurality of connectors and for each of the plurality of light facets a plurality of corresponding sockets.

2. Lighting device according to claim 1, wherein a plurality of mounting boards are arranged on each of the plurality of light facets.

3. Lighting device according to claim 1, wherein the supply circuit comprises an accumulator system for supplying a backup voltage to at least one of the lighting elements.

4. Lighting device according to claim 1, further comprising a supporting plate on which the one or more assemblies rest.

5. Lighting device according to claim 4, wherein the supporting plate comprises centring lugs arranged on a perimeter thereof for centring the dome.

6. Lighting device according to claim 4, wherein a threaded rod is provided for supporting at least said supporting plate and said dome.

7. Lighting device according to claim 1, further comprising a transparent protective dome covering the one or more assemblies.

8. Lighting device according to claim 1, wherein the supply circuit comprises an electric transformer member for supplying a supply voltage with a given value in accordance with an input voltage having variable voltages.

9. Lighting device according to claim 1, wherein at least one of said lighting elements are made up of at least one LED.

10. Lighting device according to claim 1, wherein a video camera is arranged in the lighting device.

11. Lighting device according to claim 10, wherein images are transmitted via a power cable of the lighting device by a PLC coupling circuit.

12. Lighting device according to claim 1, further comprising a Wi-Fi booster in a base of the lighting device.

13. Striplight made up of a plurality of said lighting devices according to claim 1, powered by a power cable.

* * * * *